United States Patent [19]

Meyer

[11] 4,077,533

[45] Mar. 7, 1978

[54] TENNIS BALL RETRIEVING DEVICE

[76] Inventor: John Meyer, 825 N. Glendale Ave., Glendale, Calif. 91206

[21] Appl. No.: 714,637

[22] Filed: Aug. 16, 1976

[51] Int. Cl.[2] ..... B60P 1/00

[52] U.S. Cl. ..... 214/356; 56/328 R

[58] Field of Search ..... 214/355, 356; 56/328 R

[56] References Cited

U.S. PATENT DOCUMENTS

| | | | |
|---|---|---|---|
| 2,729,046 | 1/1956 | Patterson | 214/356 |
| 3,102,647 | 9/1963 | Bonney | 214/356 |
| 3,593,868 | 7/1971 | Folz | 214/356 |
| 3,856,165 | 12/1974 | Gustafson et al. | 214/356 |
| 3,902,749 | 9/1975 | Falitz | 214/356 |

FOREIGN PATENT DOCUMENTS

| | | | |
|---|---|---|---|
| 724,688 | 11/1966 | Italy | 56/328 R |

*Primary Examiner*—Drayton E. Hoffman
*Assistant Examiner*—Lawrence E. Williams
*Attorney, Agent, or Firm*—Matthew P. Lynch

[57] ABSTRACT

A rotor at the front of a tennis ball retrieving device is journalled for rotation in a direction whereby tennis balls lying at random on a tennis court or like surface are picked up and conveyed upwardly rearwardly to the top of a receptacle. An arcuate guide plate is provided for cooperation with the rotor and is positioned between the latter and the receptacle, the conforming guide plate being spaced from the rotor such as to form a ball transfer path therebetween. The path has a width less than the diameter of a tennis ball and extends from an upper point lying in a plane coinciding with the upper level of the receptacle to a lower point proximate ground surface. In operation, rotational forces exerted by the resilient rotor surface act upon the balls to raise the latter through the transfer path to the upper point thereof where such elevated balls are ejected in rearward direction, gravity causing the balls to drop into the receptacle. A pair of opposed diverging retriever arms are secured to the front end of the retrieving device to enlarge the effective sweep range thereof.

22 Claims, 3 Drawing Figures

TENNIS BALL RETRIEVING DEVICE

RELATED PATENTS

Apparatus for retrieving tennis balls which utilize rotary elements journalled for rotation in a direction whereby the balls are picked up and conveyed into a receptacle or receiving chamber, are disclosed in U.S. Pat. No. 3,485,398 issued Dec. 23, 1969 to Offner and in U.S. Pat. No. 3,593,868 issued July 20, 1971 to Folz. In addition, U.S. Pat. No. 3,102,647 issued Sept. 3, 1963 to Bonney discloses a similar system employing a rotary element to retrieve golf balls

BACKGROUND OF THE INVENTION

1. Field of the Invention

The invention relates generally to improvements in ball retrieving devices and more particularly to a tennis ball retrieving device having a high retrieval efficiency and improved ball entrainment and transfer means.

2. Description of the Prior Art

With the ever increasing boom in the sport of tennis, teaching sessions in this sport by tennis professionals are in great demand. Usually, large numbers of balls are used during such sessions. The tedious job of having to pick up the balls following one such session and prior to the next one and with the balls lying at random positions all over the court, becomes a time-consuming and strenuous task. Sometimes the retrieval of grounded balls is accomplished by picking the balls up by hand while in other instances mechanized ball retrievers are used. Such ball retrievers range from the conventional tennis ball pick up tubes and baskets to the more sophisticated retrieving devices which utilize rotary members which by rotational movement in a given direction automatically entrain and transfer the balls from the surface into a ball chamber or receptacle. Although developed to facilitate the retrieval of balls in a relatively short period of time, tennis ball retrievers presently used still pose a problem as regards their complex and intractable systems and parts combined with their low retrieval efficiency of tennis balls, taking into consideration that at the present time literally hundreds of balls are to be retrieved daily.

SUMMARY OF THE INVENTION

In accordance with the present invention, a tennis ball retrieving device is provided which overcomes the aforementioned problems and which satisfies the important criteria of being durable, simple in construction and having a high efficient retrieval of tennis balls.

The present invention further provides a tennis ball retrieving device which is easily invertible from a ball retriever to a ball dispenser.

According to the invention, the tennis ball retrieving device essentially comprises a rotor at the front of a tennis ball retrieving device and which is journalled for rotation in a direction whereby tennis balls lying at random on a tennis court or like surface are picked up and are conveyed rearwardly to the top of a receptable disposed rearwardly of the rotor. An arcuate guide plate is provided for cooperation with the rotor and is positioned between the latter and the receptable, the conforming guide plate being spaced from the rotor such as to form a ball transfer path therebetween. The path has a width less than the diameter of a tennis ball and extends from an upper point lying in a plane coinciding with the upper level of the receptacle to a lower point proximate ground surface. In operation, rotational forces exerted by the resilient outer rotor surface act upon the balls to raise the latter through the transfer path to the upper point thereof where said elevated balls are ejected in rearward direction, gravity causing the balls to drop into the receptacle. A pair of opposed diverging retriever arms are secured to the front end of the retrieving device to enlarge the effective sweep range thereof.

The width of the rotor can be dimensioned such as to enable a multitude of tennis balls to be picked up simultaneously and to be conveyed to the ball receptacle.

The above and still further objects, features and advantages of the present invention will become apparent upon consideration of the following detailed description of one specific embodiment thereof, especially when taken into consideration with the accompanying drawings.

DESCRIPTION OF THE PREFERRED EMBODIMENT

Figures 1, 2:
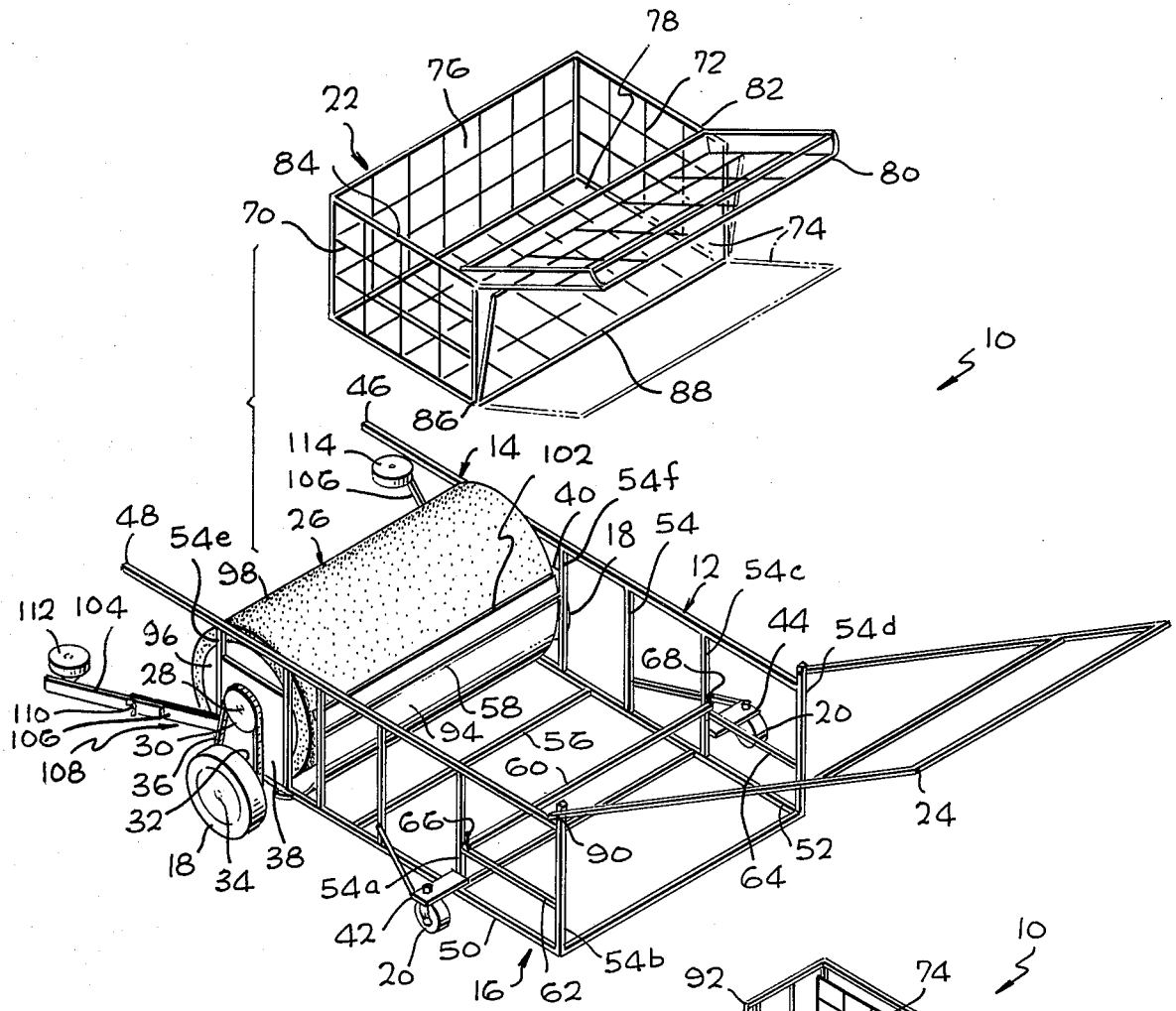
FIG. 1 is an exploded perspective view of the tennis ball retrieving device embodying the invention.
FIG. 2 is a perspective view of the ball retrieving device of FIG. 1, the illustration showing the device inverted from its usual operating position to an upright or stand-up position in which the apparatus serves as a ball dispenser.
Figure 3:
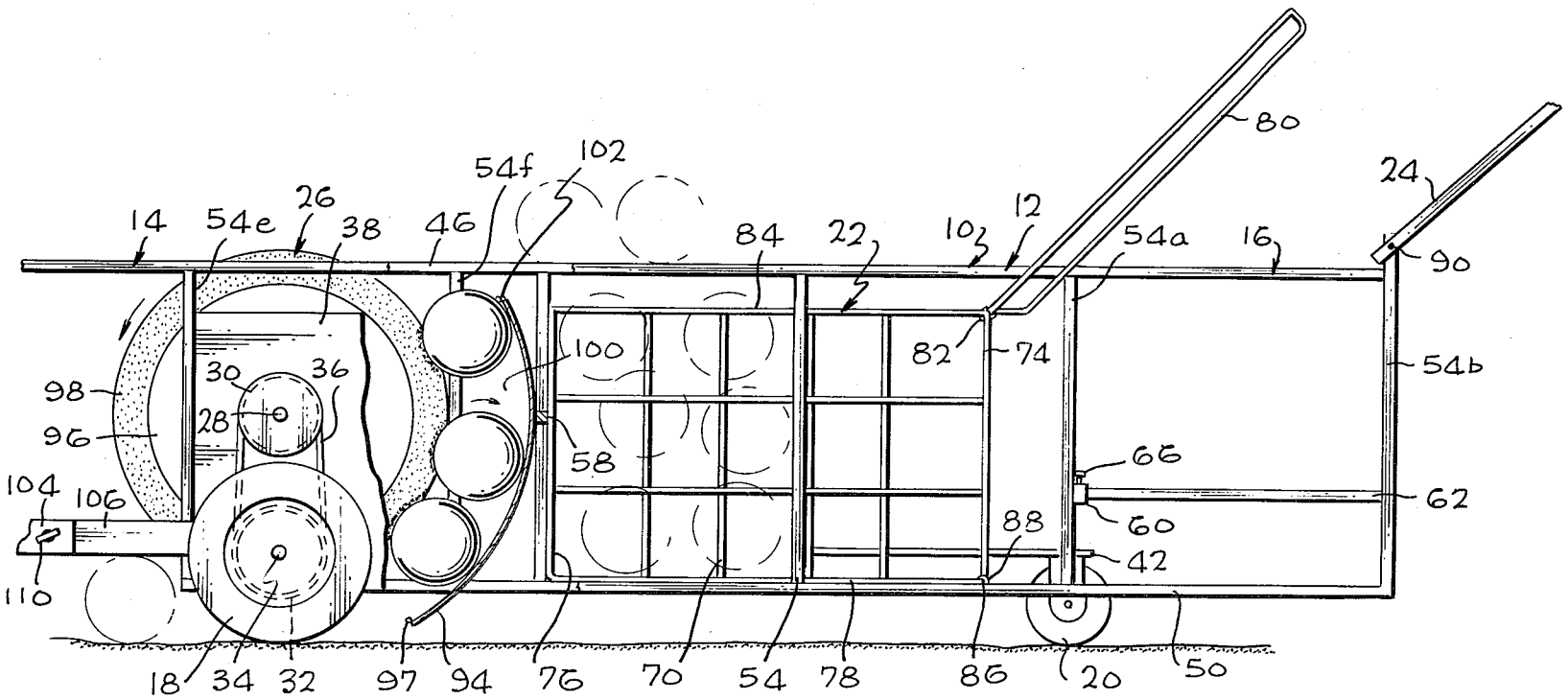
FIG. 3 is a side elevational view, partially in section, of the ball retrieving device of FIG. 1.

Referring now to the drawings in which like reference numerals index like parts and with attention initially directed to FIGS. 1 and 3, there are shown a tennis ball retrieving device, referenced generally by the numeral 10, embodying the present invention.

The retrieving device 10 is seen to comprise a substantially elongated support frame 12 having a forward frame portion 14 and a rearward frame portion 16. In operating position the frame 12 extends generally in a horizontal plane parallel to ground level. Provided at the forward and rearward frame portions 14, 16 are a pair of roller members 18, 20, respectively, which enable movement of the device 10 over the surface of a field, tennis court, arena, or other area where it is desired to retrieve balls. Simultaneously, the roller members 18, 20 serve as supports for the device 10 with respect to ground.

A ball receptacle 22 is removably carried by a support frame 12 at a location generally midway of the frame. The effective receptacle area, however, is adjustable and may be enlarged as will hereinafter be described in detail. A generally U-shaped handle 24 is attached to rearward portion 16 of support frame 12 for the purpose of imparting motion of the device 10.

A rotary drum 26 is journalled in the frame forward portion 14 for rotational movement during operation of the device for picking up balls. The drum 26 is generally cylindrical and includes a pair of fixed shaft ends 28, one shown, at opposite ends of the drum and which extend in axial alignment. One of the shaft ends 28, for example the one shown, is provided with a sprocket wheel 30 which through a chain member 36 cooperates with a second sprocket wheel 32 mounted on a freely rotatable shaft which provides a bearing for one of the roller members 18, for example the one shown. As will be appreciated, the sprocket chain 36 is coupled to and interconnects the sprocket wheels 30, 32 in the usual manner.

As the device is pushed over a surface, e.g., in forward direction, the roller members 18, 20 are driven in counterclockwise direction and, by means of the sprocket drive arrangement 30, 32 and 36 in cooperation with one of the shafts of roller members 18 and drum 26, simultaneous rotational movement in corresponding rotation direction is transmitted to the drum.

Typically, the roller members 18 are in the form of a pair of wheels journalled on opposite sides of forward portion 14 of support frame 12 for free rotation such as by a pair of axially aligned shaft members 34, only one shown. The shafts 34 are disposed in substantial axial alignment and are rotatably secured to a pair of frame side plates 38, 40 attached to the frame forward portion 14 at opposite sides thereof. The manner of rotatably mounting the shafts 34 on the side plates 38, 40 may be done in any well-known manner, not shown.

In the arrangement shown, the roller members 20 are journalled at opposite sides of rearward portion 16 of support frame 12 at the lower elements thereof. The roller members 20, typically, are swivel wheels of the caster-type supported by the frame via bracket members 42, 44 for universal pivoting or rotation of facilitate moving or rolling of the device 10 across ground surface.

The support frame 12 is seen to include a pair of parallel opposed side structured formed by a pair of longitudinally extending upper bar members 46, 48, a pair of longitudinally extending lower bar members 50, 52, and a plurality of upright bar members 54 interconnecting the respective upper and lower bar members 46, 48 and 50, 52, the latter having removably attached thereto a pair of diverging retriever arms, described hereinafter. The frame side structures are spaced apart by a plurality of transversely extending bar members 56, the latter forming the frame bottom which supports the receptacle 22. Additional transversely extending, parallel bar members 58, 60 are provided adjacent the frame forward and rearward portions 14, 16, respectively, and which extend in spaced apart relation across the frame 12, at a height midway between the upper and lower members 46, 48 and 50, 52. The parallel spaced bar members 58, 60 respectively form the forward and rearward boundaries for the ball receptacle 22 and which prevent the latter from shifting in the longitudinal direction relative to the frame. The overall dimension of the receptacle 22 closely corresponds to the generally rectangular frame receptacle area defined by the bottom bar members 56, and the side- and forward and rearward bar members 46, 48 and 58, 60, respectively. In case a receptacle of greater capacity and, hence, of greater dimension is desired, it is only necessary to enlarge the effective ball receptacle area on the frame to enable such an enlarged receptacle to be carried by the frame. This is accomplished by adjusting the given distance between the bar members 58, 60. As shown in FIG. 1, the transverse bar member 60 is adjustably mounted on a pair of crossbar members 62, 64 extending in the elongation of the frame, transversely intermediate the upright bar members 54a, 54b and 54c, 54d, respectively. The bar member 60 is slidably movable along the members 62, 64, lengthwise relative to the frame and is operative to enlarge the given receptacle area to a point bounded by the bar members 54b, 54d, the latter forming the rearward extremity of the frame. Positioning means in the form of clamp members 66, 68 are secured to the outer opposite ends of the transverse bar member 60 and serves to retain the latter member in a desired position relative to the bar members 62, 64.

As clearly shown in FIG. 1, the ball receptacle 22 is in the form of a basket of the open-wire type. The basket is seen to comprise four side panels 70, 72 and 74, 76, a bottom 78 and an upper lid 80. The lid 80 is pivotally mounted at 82 to the upper receptacle element 84, enabling the lid 80 to be opened and closed, as required. For example, in operating position the lid is in open position and rests backwardly on the upper receptacle element 84. In non-operating position, for example when the device 10 is inverted from a ball retriever to a ball dispenser as shown in FIG. 2, the lid is closed. In the illustration shown in FIG. 2, the device is placed in an upright ball dispensing position with the lid 80 in closed position to prevent unwanted escape of balls from the receptacle. To enable dispensing of the balls from the receptacle in the position shown, also the rearward panel 74 is arranged to be moved between an open and closed position about a pivot 86 at the lower or bottom receptacle element 88, as viewed in FIG. 1, in which condition the panel 74 is pivoted backwardly through 180° and rests against the bottom of the frame rearward portion 16. To adequately support the device 10 in the dispensing position of FIG. 2, a pair of tubular extension members 46a, 48a are removably attached to the forward extremities of bar members 46, 48.

The handle 24, as shown, is pivotally mounted at 90, 92 at the upper extremities of the bar members 54b, 54d. The pivots 90, 92 enable the handle to be pivoted, for instance, to the position shown in FIG. 2, thereby facilitating easy dispensing of the balls from the receptacle.

Provided directly forwardly of the receptacle 22 and immediately adjacent the rotary drum 26 at the frame forward portion 14 is an arcuate guide plate member 94 made, typically, of sheet metal. The guide plate 94 is mounted in spaced relation relative to the rotary drum 26 and extends forwardly downwardly from a point coinciding with the plane of the upper receptacle element 84 to a point in close proximity with ground surface. Typically, the clearance between the lowest guide plate point 97 and ground is about .25". The guide plate 94 and the drum 26 are mounted intermediate the frame side structures at the forward portion 14 of the frame. The guide plate 94 is stationary and is fixedly secured at its upper end to the frame transverse bar member 58 and at its lower end is secured to the frame structure at a point behind the side plates 38, 40.

The rotary drum 26 includes a main body 96 covered with a layer or mass of resilient material 98, typically a foam material. In a preferred arrangement of the invention, the layer of foam material has a thickness of 1 inch. The drum has a highest point disposed in a plane substantially higher than the upper level or top of the receptacle which, as indicated hereinbefore, coincides with the highest point of the guide plate. The lowest point of the drum is disposed directly adjacent ground. Typically, the drum has a circumferential dimension of approximately 34 inches and the clearance between the lowest drum point and ground surface is approximately 2.25 inches. Also, according to the invention, the spacing between the inner guide plate surface and opposing drum wall is less than the diameter of a tennis ball. The lowest point 97 of the guide plate 94 is disposed proximate the lowest point of the drum. When the device is moving forwardly, counterclockwise rotational movement is imparted to the rotary drum and any ball resting in the path of the drum is engaged thereby and swept rearwardly into engagement with the arcuate guide plate 94. At this point, the ball has entered the transfer path 100 formed by the spacing between the guide plate 94 and drum 26 and is frictionally carried upwardly rearwardly to the upper extremity 102 of the guide plate where it is released from engagement with the drum and guide plate, whereupon due to gravitational forces acting upon the ball, the latter drops backwardly into the receptacle.

During the transfer of the ball through the transfer path 100, considerable rotational forces are created between the ball and drum due to compression of the foam layer 98 and, to a lesser degree, compression of the tennis ball itself. As a result, the balls are efficiently and positively directed through the spacing or transfer path 100 and, upon reaching the uppermost extremity 102 of the guide plate, are ejected from the spacing upwardly and rearwardly relative thereto and, due to gravity, collected in the receptacle.

The drum width may be chosen such as to collect a multitude of balls in a matter of seconds. For example, it has been found that with a drum width of about four feet, a multitude of balls in excess of 300 may be collected within less than 30 seconds.

As shown, the rotation axes of the drum 26 and wheels 18 are disposed in substantial parallelism, with the axes 28 of the drum extending through the frame side plates 38, 40, the latter being secured to upright bar members **54*e*, 54*f* at the frame forward portion 14**.

To increase the width of the sweep of the device 10, a pair of forwardly extending diverging arm members 104, 106 are removably secured to diverging frame portions 108, one shown, at the forward end of the frame 12. The frame portions 108 are welded to the lower ends of the bar members **54*e* at the frame forward extremity. The arm members 104, 106 may be pivotally or otherwise connected such as, for example, by means of a wing nut arrangement 110. If pivotally secured, the arm members 104, 106 may be pivoted upwardly to an out-of-the-way position if desired. The arm members 104, 106 preferably are disposed at an angle of 30° with respect to a horizontal plane parallel to ground level. A wheel or roller 112, 114 is provided on each of the arm members and is preferably journalled in the proximity of the outer ends thereof. The wheels 112, 114 are mounted for rotation about an axis perpendicular to the horizontal and normal to the rotation axis of the drum. The wheels 112, 114 may serve as bumpers or may be operative to dislodge balls from tight corners or balls lying against vertical walls or wire structures or prevent entanglement of the arm members 104, 106** with upstanding wire structures such as nets, fences, and the like.

Although the invention has been described as being embodied in a tennis ball retrieving device, it will be appreciated that the principle underlying the novel structural arrangement of the ball retrieving elements which forms the inventive portion of this application may equally beneficially be applied to retrieving apparatus for balls other than tennis balls.

From a detailed consideration of this description, it will be apparent to those skilled in the art that this invention may be employed in a number of different ways through the use of routine skill in this field. For this reason, the present invention is not to be considered as being limited except by the appended claims defining the invention.

I claim:

1. A tennis ball retrieving and dispensing device particularly for use on planar ground surfaces comprising, in combination:

a vehicle including an elongated support frame having a front and rear portion, a top and bottom extending axially between said front and rear portion, and means at said rear portion to impart motion to said vehicle, said device being turnable from a horizontal ball retrieving position to an upright ball dispensing position in which said rear portion is oriented upwardly;

means at said front portion of said frame for supporting said vehicle in said upright dispensing position;

a ball receptacle removably carried by said frame on said bottom thereof and having a hinged upper lid open in said ball retrieving position and closed in said ball dispensing position, and a hinged door at the rear of said receptacle, said door being open in said ball dispensing position and closed in said ball retrieving position, said lid when open and closed in said ball retrieving position, said lid when open being adapted to permit entry of balls conveyed towards said receptacle;

means for adjustably varying the effective receptacle area on said frame;

an arcuate ball guide member secured to said frame forwardly of said receptacle directly adjacent said receptacle at the front thereof, said guide member extending circumferentially from an upper point at a level coinciding closely with the top of said receptacle to a lower point in close proximity with the ground surface, forwardly relative to the bottom of said receptacle, said lower point being spaced from the ground surface a distance less than the diameter of a standard tennis ball;

a rotary drum journalled in said frame for rotation during movement of said vehicle for retrieving balls, said drum being disposed forwardly of said guide member in spaced relation therewith and extending circumferentially from a point substantially higher than said upper point of said guide member and said level of said receptacle top to a point approximating said lower point of said guide member, the sense of rotation of said drum being such as to engage a ball on said surface and to frictionally raise said ball through the spacing defined between said guide member and drum to said receptacle top, at which point the elevated ball is forcibly ejected from said spacing, gravity causing the ball to descend rearwardly into said receptacle; and motion transmitting means between said drum and said roller means adjacent said front portion of said frame for imparting synchronous rotational movement from said latter means to said drum.

2. A device in accordance with claim 1, further comprising spaced apart diverging arm members carried by said support frame at said front portion thereof, and roller means provided adjacent the outer extremities of said arm members for preventing entanglement of said arm members with vertically extending wire structures and for dislodging balls laying against such structures and directing such balls into the path of said rotary drum.

3. A device in accordance with claim 2, wherein said diverging arm members extend outwardly from the front portion of the support frame at an angle of 30° with respect to a horizontal plane parallel to ground level.

4. A device in accordance with claim 2, wherein said roller means provided on the outer extremity of said arm members are in the form of wheel members freely rotatable about an axis normal to the axis of rotation of said rotary drum.

5. A device in accordance with claim 1, wherein said guide member and said rotary drum extend transversely to the elongation of said frame.

6. A device in accordance with claim 1, wherein said support frame comprises a composite, generally rectangular cage-like structure positioned intermediate said front and rear portion of said frame, directly adjacent said guide member and extend rearwardly from the latter, said cage-like structure being open at the top to permit positioning and removal of said ball receptacle with respect to said support frame.

7. A device in accordance with claim 6, wherein said ball receptacle is in the form of a generally rectangular basket-type wire structure.

8. A device in accordance with claim 1, wherein said guide member is in the form of an arcuate plate having a curavature corresponding closely with the circumference of said drum, said arcuate plate being spaced throughout from said drum by a distance less than the diameter of a standard tennis ball.

9. A device in accordance with claim 1, wherein said support frame comprises a pair of composite side structures each including oppositely disposed, parallel upper and lower longitudinally extending bar members, said upper bar members constituting the top of said frame and said lower bar members interconnected at predetermined regions by transversely extending cross bar members and forming the bottom of said frame, and wherein said frame further comprises a front and rear bar member extending transversely to the elongation of said frame and interconnecting a pair of said cross bar members and forming a cage-like compartment in said frame for accommodating said ball receptacle.

10. A device in accordance with claim 1, wherein said support frame comprises oppositely disposed parallel side frame structures adjacent said front portion of said frame and a cross bar interconnecting said parallel structures transversely to the elongation of said frame, and wherein said guide member is secured to said cross bar and said rotary drum is journalled for rotation intermediate said opposed side frame structures.

11. A device in accordance with claim 1, wherein said rotary drum is substantially cylindrical and includes an inner body of non-resilient material and an outer cylindrical mass of resilient material.

12. A device in accordance with claim 11, wherein said resilient material is a foam material.

13. A device in accordance with claim 1, wherein said roller means comprises a pair of wheels fixed at the ends of rotatable shafts journalled on opposite sides at the front portion of the frame for free rotation relative thereto, said rotary drum comprising axially aligned shaft members journalled for rotation about an axis between said opposite sides, and wherein said motion transmitting means comprises a sprocket wheel drive between one of the rotatable shafts of said pair of wheels and one of said shaft members of said rotary drum.

14. A device in accordance with claim 13, wherein said sprocket wheel drive comprises a first sprocket wheel mounted on said one of said rotatable shafts of said pair of wheels, a second sprocket wheel on said one of said shaft members of said rotary drum, and a chain member between said first and second sprocket wheels, whereby rotation of the wheel on said one of said rotatable shafts of said pairs of wheels transmits simultaneous rotation in corresponding direction to said one of said shaft members of said rotary drum.

15. A device in accordance with claim 1, wherein said roller means comprises a pair of swivel wheels of the caster-type mounted on opposite sides at the rear portion of the support frame.

16. A device in accordance with claim 1, wherein said roller means comprises a pair of wheels fixed at the ends of rotatable shafts journalled for rotation on opposite sides at the front portion of the support frame.

17. A device in accordance with claim 1, wherein the motion imparting means at the rear portion of the support frame is in the form of a substantially U-shaped handle member pivotally secured to the frame to facilitate manual pushing and movement of said vehicle.

18. A device in accordance with claim 1, wherein said frame comprises a first pair of parallel, spaced apart elongated upper bar members extending axially from said front to said rear portion of said frame and forming the top thereof, and a second pair of parallel, spaced apart elongated lower bar member interconnected by a plurality of transverse bar members extending normal to the elongation of said frame and forming the bottom thereof.

19. A device in accordance with claim 18, wherein said frame further comprises a plurality of cross bar members extending normal to the elongation of said frame and interconnecting said upper and lower bar members to form the sides of said frame, and wherein a first transverse bar member is provided intermediate said cross bar members and interconnecting said sides of said frame adjacent the front portion thereof, and a second transverse member intermediate said cross bar members and interconnecting said sides of said frame adjacent the rear portion thereof, said guide member being secured to said first transverse bar member at said front portion of said frame.

20. A device in accordance with claim 19, wherein said second transverse bar member adjacent said rear portion of said frame is axially displaceable relative to the elongation of said frame to adjust the effective receptacle area intermediate said first and second transverse bar members interconnecting said sides of said frame.

21. A device in accordance with claim 20, wherein the network of transverse and cross bar members of said frame and the displaceable second transverse bar member form a variable cage-like structure for receiving said receptacle, and wherein said arm members form an extension of said pair of elongated lower bar members, and said second pair of elongated upper bar members each are provided with an axial extension having a length corresponding with the length of said arm members, the latter and said extensions of said upper bar members forming said means for supporting said vehicle in said upright position.

22. A device in accordance with claim 21, wherein said arm members and said extensions of said upper bar members are detachably mounted to the frame forward position.

* * * * *